US009232621B2

(12) United States Patent
Taniguchi

(10) Patent No.: US 9,232,621 B2
(45) Date of Patent: Jan. 5, 2016

(54) APPARATUS AND METHOD FOR ENERGY BEAM POSITION ALIGNMENT

(71) Applicant: USHIO DENKI KABUSHIKI KAISHA, Tokyo (JP)

(72) Inventor: Yuta Taniguchi, Yokohama (JP)

(73) Assignee: USHIO DENKI KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/680,909

(22) Filed: Apr. 7, 2015

(65) Prior Publication Data

US 2015/0296603 A1 Oct. 15, 2015

(30) Foreign Application Priority Data

Apr. 15, 2014 (JP) ..... 2014-083452

(51) Int. Cl.
*H05G 2/00* (2006.01)

(52) U.S. Cl.
CPC ..... *H05G 2/006* (2013.01); *H05G 2/008* (2013.01)

(58) Field of Classification Search
CPC ..... H05G 2/006; H05G 2/008
USPC ..... 250/504 R
See application file for complete search history.

(56) References Cited

U.S. PATENT DOCUMENTS

| | | | | |
|---|---|---|---|---|
| 6,973,164 | B2 * | 12/2005 | Hartlove | H05G 2/008 372/5 |
| 7,427,766 | B2 | 9/2008 | Jonkers et al. | |
| 7,928,416 | B2 | 4/2011 | Fomenkov | |
| 8,704,200 | B2 | 4/2014 | Bykanov et al. | |
| 2011/0079736 | A1 * | 4/2011 | Hansson | H05G 2/003 250/504 R |

FOREIGN PATENT DOCUMENTS

| | | | |
|---|---|---|---|
| EP | 2170020 | A1 | 3/2010 |
| JP | 2005-017274 | A | 1/2005 |
| JP | 2007-505460 | A | 3/2007 |
| JP | 2010-514214 | A | 4/2010 |
| JP | 4623192 | B2 | 11/2010 |

* cited by examiner

*Primary Examiner* — Michael Maskell
(74) *Attorney, Agent, or Firm* — Studebaker & Brackett PC

(57) ABSTRACT

A light source device irradiates a material with a first beam, and directs a second beam toward a first position on the material, which is irradiated with the first beam. An alignment mechanism includes an optical unit to allow the first beam to pass therethrough, and to reflect the second beam and direct the second beam in a same direction as the first beam. The alignment mechanism also includes a mirror to reflect the second beam, a beam detecting unit, and a branching unit to receive the first beam which has passed the optical unit and the second beam which is reflected by the optical unit. The mirror adjusts an incident position of the second beam on the optical unit. The branching unit adjusts the first position of the first beam on the material and a second position of the second beam on the material.

17 Claims, 12 Drawing Sheets

APPARATUS AND METHOD FOR ENERGY BEAM POSITION ALIGNMENT

FIELD OF THE INVENTION

The present invention relates to an apparatus and method for position alignment of energy beams, which are used with, for example, a light source device configured to emit extreme ultraviolet light. More specifically, the present invention relates to an apparatus and method for aligning irradiation positions of two energy beams with each other.

DESCRIPTION OF THE RELATED ART

As semiconductor integrated circuits are designed in a fine structure and/or in a highly integrated manner, a light source for exposure tends to have an even shorter wavelength. As a next generation light source for exposure of semiconductor, an extreme ultraviolet (EUV) light source is studied. Such light source can emit extreme ultraviolet light at a particular wavelength (i.e., 13.5 nm).

There are some known methods for the EUV light source device to generate (emit) the extreme ultraviolet light. One of the known methods heats an EUV species (seed) for excitation. This generates a high temperature plasma. Then, the extreme ultraviolet light is extracted from the high temperature plasma.

The EUV light source device that employs such method is generally categorized into two types depending upon a way of generating the high temperature plasma. One type is a laser produced plasma (LPP) type EUV light source device. Another type is a discharge produced plasma (DPP) type EUV light source device.

DPP Type EUV Light Source Device

A mechanism of the extreme ultraviolet radiation of the DPP type EUV light source device will be described briefly.

According to the DPP type EUV light source device, electrodes are placed in, for example, a discharge vessel, and the discharge vessel is filled with a material gas (i.e., gaseous high temperature plasma material atmosphere). Then, discharge is caused to take place between the electrodes in the plasma material atmosphere so as to produce initial plasma.

A self magnetic field results from a DC current that flows between the electrodes upon the discharging, and causes the initial plasma to shrink. As a result, the density of the initial plasma increases, and the plasma temperature steeply rises. This phenomenon is referred to as "pinch effect" hereinafter. Heating caused by the pinch effect elevates the plasma temperature, and the EUV light is emitted from the high temperature plasma.

In recent years, the DPP type EUV light source device uses solid or liquid Sn or Li. The solid or liquid Sn or Li is supplied to the surfaces of the electrodes, across which the discharge takes place, and irradiated with an energy beam such a laser beam for vaporization. Subsequently, the high temperature plasma is generated by the discharging. The plasma prepared by this approach is often referred to as "laser assisted gas discharge produced plasma (LAGDPP)." The following description deals with an EUV light source device when the energy beam is the laser beam.

FIG. 9 of the accompanying drawings schematically illustrates an EUV light source device that employs a DPP method (LAGDPP method) disclosed in Japanese Patent Application Laid-open Publications No. 2007-505460 (Patent Literature 1) or WO2005/025280.

The EUV light source device has a chamber 1, which is the discharge vessel. In the chamber 1, there are provided a discharge part 1*a* and an EUV light condensing part 1*b*. It may be said that the chamber 1 is defined by the discharge part 1*a* and the EUV light condensing part 1*b*. The discharge part 1*a* includes a pair of disk-like discharge electrodes 2*a* and 2*b*. The EUV light condensing part 1*b* includes a foil trap 5 and an EUV light condensing mirror 9, which is a light condensing unit.

A gas discharge unit 1*c* is attached to the EUV light source device. The gas discharge unit 1*c* is used to evacuate the interior of the EUV light source device (i.e., discharge part 1*a* and the EUV light condensing part 1*b*).

The disk-like electrodes 2*a* and 2*b* are spaced from each other by a predetermined distance, and have rotating motors 16*a* and 16*b*, respectively. As the motors 16*a* and 16*b* rotate, the electrodes 2*a* and 2*b* rotate about shafts 16*c* and 16*d*.

A high temperature plasma material 14 is a material to emit EUV light at a wavelength of 13.5 nm. The plasma material 14 is, for example, liquid tin (Sn) and received in containers 15*a* and 15*b*. The plasma material 14 is heated and becomes melted metal in the containers 15*a* and 15*b*. The temperature of the melted metal is adjusted by a temperature adjusting unit (not shown) disposed in, for example, each of the containers.

The electrodes 2*a* and 2*b* are partially immersed in the plasma material 14 in the associated containers 15*a* and 15*b*, respectively. The liquid plasma material 14 that rides on the surface of each of the electrodes 2*a*, 2*b* is moved into the discharge space upon rotation of the electrode 2*a*, 2*b*.

The high temperature plasma material 14 which is moved into the discharge space is irradiated with the laser beam (energy beam) 17 emitted from a laser source (energy beam radiating unit) 12. Upon irradiation with the laser beam 17, the high temperature plasma material 14 evaporates.

While the plasma material 14 is evaporated upon irradiation with the laser beam 17, a pulse electric power is applied to the electrodes 2*a* and 2*b* from a power source unit 3. Thus, a pulse discharge is triggered between the electrodes 2*a* and 2*b*, and a plasma P is produced from the plasma material 14. It should be noted that the electric power is applied to the electrodes 2*a* and 2*b* before, for example, the plasma material 14 is irradiated with the laser beam 17.

A large current is caused to flow upon the discharging. The large current heats and excites the plasma such that the plasma temperature is elevated. As a result, the EUV light is emitted from the high temperature plasma P.

It should be noted that the pulse electric power is applied between the discharge electrodes 2*a* and 2*b*. Thus, the resulting discharge is the pulse discharge, and the emitted EUV light is light emitted like a pulse, i.e., pulse light (pulsing light).

The EUV light emitted from the high temperature plasma P is condensed to a condensing point f of the light condensing mirror 9 (also referred to as "intermediate condensing point f" in this specification) by the EUV light condensing mirror 9. Then, the EUV light exits from an EUV light outlet 8, and is incident to an exposure equipment 40 attached to the EUV light source device. The exposure equipment 40 is indicated by the broken line in FIG. 9.

In general, the EUV light condensing mirror 9 includes a plurality of thin concave mirrors disposed at high precision in a nest form. The reflecting plane of each of the concave mirrors has, for example, a spheroid shape (shape of ellipsoid of revolution), a shape of paraboloid of revolution, or a Walter shape. Each of the concave mirrors has a rotating body shape. The Walter shape is a concave shape with its light incident surface including hyperboloid of revolution and ellipsoid of revolution in this order from the light incident side, or hyperboloid of revolution and paraboloid of revolution.

According to the DPP method (LAGDPP method), it is easy to vaporize Sn, which is solid at room temperature, in the vicinity of the discharge region where the discharge takes place. The discharge region is the space for the discharge between the discharge electrodes. Specifically, it is possible to efficiently feed the vaporized Sn to the discharge region, and therefore it becomes possible to efficiently extract the EUV radiation at the wavelength of 13.5 nm after the discharging.

The EUV light source device disclosed in Japanese Patent Application Laid-Open Publications No. 2007-505460 (WO2005/025280) has the following advantages because the discharge electrodes are caused to rotate.

(i) It is possible to always feed a solid or liquid high temperature plasma material to the discharge region. The plasma material is a material for a new EUV producing species.

(ii) Because the position on each discharge electrode surface, which is irradiated with the laser beam, and the position of the high temperature plasma generation (position of the discharge part) always change, the thermal load on each discharge electrode reduces, and therefore it is possible to reduce or prevent the wear of the discharge electrodes.

In the EUV light source device, the materials on the surfaces of the electrodes are evaporated upon irradiation of the laser beams, and the discharge is triggered between the electrodes to generate the plasma. However, if the efficient generation of the EUV radiation is desired, the vaporized plasma material (e.g., tin) that is fed to the discharge region has to have a certain gas density (high density). This is because the ion density of the high temperature plasma that is irradiated with the EUV light is $10^{17}$ to $10^{20}$ $cm^{-3}$, and the ion density of the initial plasma, which is the high temperature plasma prior to the pinching, has to be approximately $10^{16}$ $cm^{-3}$. In other words, if the gas density of the plasma material fed to the discharge region is smaller than $10^{16}$ $cm^{-3}$, for example, the plasma generated upon the discharge does not emit EUV light at the wavelength of 13.5 nm even if the discharge is triggered.

In the EUV light source device disclosed in Japanese Patent Application Laid-Open Publications No. 2007-505460 (WO2005/025280), the gas of the plasma material is introduced between the electrodes (in the discharge space) as the liquid or solid materials applied on the surfaces of the electrodes are irradiated with the laser beams. However, the materials that are vaporized upon the irradiation of the laser beams spread three-dimensionally in the space between the two electrodes. Thus, it is difficult to regulate (control) the density of the gas of the plasma material introduced to the discharge region. When the spreading material gas reaches the two opposite electrodes and the discharge starts, the material gas density at the start of the discharge is not always the desired density for the EUV radiation.

To overcome such problem, Japanese Patent No. 4623192 (Patent Literature 2) discloses an EUV light source device. This EUV light source device includes a first energy beam irradiation unit and a second energy beam irradiation unit. The material fed to each of the two discharge electrodes is irradiated with a first energy beam from the first energy beam irradiation unit such that the material is evaporated and the discharge is triggered between the two electrodes. After the first energy beam is emitted to the material from the first energy beam irradiation unit, a second energy beam is emitted from the second energy beam irradiation unit until (before) the discharge starts between the two discharge electrodes. The second energy beam is directed to the material on the discharge electrode in an area which is irradiated with the first energy beam. The second energy beam is used to further evaporate the material. As shown in FIG. 10 of the accompanying drawings, for example, the EUV light source device includes a first laser source (energy beam irradiation unit) 12*a* to emit a first laser beam (energy beam) 17*a*, and a second laser source (energy beam irradiation unit) 12*b* to emit a second laser beam (energy beam) 17*b*. The first laser source 12*a* has a light condensing system (optical system) 13*a*, and the second laser source 12*a* has a light condensing system (optical system) 13*b*. Each of the laser beams 17*a* and 17*b* is directed to the material (tin) 14 fed on a rotating electrode 2*a* through the associated light condensing system 13*a*, 13*b*.

The plasma material (tin) 14 on the electrode 2*a* is irradiated with the first laser beam 17*a*, and the material gas that is generated upon irradiation of the first laser beam 17*a* spreads and reaches the opposite electrode 2*b*. Thus, the material gas electrically bridges between the two electrodes 2*a* and 2*b*, and an electric current starts flowing to initiate the discharge. Before the material gas, which is generated upon irradiation of the first laser beam 17*a*, bridges between the two electrodes 2*a* and 2*b* and triggers the discharge, the plasma material (tin) 14 on the electrode 2*a* is irradiated with the second laser beam 17*b*. The second laser beam 17*b* is directed to the same area as the first laser beam 17*a*. As such, the material gas is again generated between the electrodes 2*a* and 2*b*.

The discharge is induced by the material gas that is generated upon irradiation of the first laser beam 17*a*. When the discharge starts, the material gas that is generated upon irradiation of the second laser beam 17*b* has a high gas density and exits between the electrodes 2*a* and 2*b* because only a short time elapses after the irradiation of the second laser beam 17*b*. In other words, the material gas that is generated upon irradiation of the second laser beam 17*b* does not expand (spread) three-dimensionally very much when the discharge starts.

Therefore, the material gas is compressed and heated by a magnetic pressure as the discharge current increases. Then, the pinch effect increases. Accordingly, the reached ion density and electron temperature are high enough to provide EUV radiation with a high conversion coefficient.

By appropriately deciding the irradiation timing of the second laser beam 17*b*, it is possible to control the density of the gas of the plasma material fed to the discharge region such that the density of the gas is suitable for the EUV radiation.

LPP Type EUV Light Source Device

Referring to FIG. 11 of the accompanying drawings, the LLP type EUV light source device will be briefly described.

The LPP type EUV light source device has a light source chamber 1. A material feed unit 10 to feed the material (plasma material), which is an EUV radiation species (seed), is provided near the light source chamber 1, and a material feed nozzle 20 extends into the light source chamber 1. The material (e.g., liquid droplets of tin) (Sn) is introduced into the light source chamber 1 from the material feed nozzle 20.

The interior of the light source chamber 1 is evacuated by a gas discharge unit 1*c*, such as a vacuum pump, and maintained to the vacuum state.

An excitation laser generating device 21 is a laser beam irradiation unit. A laser beam 22 from the excitation laser generating device 21 is condensed by a laser beam condensing unit 24, and introduced into the chamber 1 through a laser light inlet window 23. Then, the laser beam 22 passes through a laser beam hole 25, which is formed at an approximate center of an EUV condensing mirror 9. The laser beam 22 is directed to the material (e.g., liquid droplet of tin) released from the material feed nozzle 20. The excitation laser beam generating device 21 is, for example, a pulse laser device. A repetition frequency of the laser beam generating device 21 is several kHz. The laser beam generating device 21 is, for example, a carbon dioxide ($CO_2$) laser.

The material supplied from the material feed nozzle 20 is heated and excited upon irradiation of the laser beam 22, and becomes high temperature plasma. The EUV light is emitted from the high temperature plasma. The emitted EUV light is reflected toward an EUV light outlet 8 by the EUV condensing mirror 9, and condensed at a condensing point (intermediate condensing point) of the EUV condensing mirror 9. Then, the EUV light exits from the EUV light outlet 8, and is incident to an exposure equipment 40 connected to the EUV light source device. The exposure equipment 40 is indicated by the broken line in FIG. 11.

The EUV light condensing mirror 9 is a reflection mirror having a spherical surface. The EUV light condensing mirror 9 is coated with a multi-layer film including, for example, molybdenum and silicon. It should be noted that the EUV light condensing mirror 9 may not have the laser beam hole 25 when the excitation laser beam generating device 21 and the laser beam inlet window 23 take a particular arrangement.

The laser beam 22 to be used to generate high temperature plasma may become stray light and arrive at the EUV light outlet 8. Thus, a spectral purity filter (not shown) may be disposed in front of the EUV light outlet 8 (on the high temperature plasma side). The spectral purity filter allows the EUV light to pass therethrough, but does not allow the laser beam 22 to pass therethrough.

In recent years, a pre-pulse process is employed for the LPP type EUV light source device. The pre-pulse process is disclosed in, for example, Japanese Patent Application Laid-open Publications No. 2005-17274 (Patent Literature 3) and Japanese Patent Application Laid-open Publications No. 2010-514214 or WO2008/088488 (Patent Literature 4). In the pre-pulse process, one material is irradiated with a plurality of laser beams in the LPP type EUV light source device. An exemplary arrangement to perform the pre-pulse process is illustrated in FIG. 12. This arrangement includes a first laser source (energy beam irradiation unit) 12*a* to emit a first laser beam (energy beam) 17*a*, and a second laser source (energy beam irradiation unit) 12*b* to emit a second laser beam (energy beam) 17*b*. The laser beams 17*a* and 17*b* pass through the laser beam condensing (collecting) units 13*a* and 13*b*, respectively. The laser beam 17*b* is then reflected by a mirror 13*c*. The laser beams 17*a* and 17*b* are directed to the material (tin), which is a liquid droplet supplied from the feed unit 10. The first laser source 12*a*, the second laser source 12*b* and the feed unit 10 are controlled by a controller 30.

With this arrangement, firstly, the material is irradiated with the first laser beam 17*a* (pre-pulse) to generate a weak plasma. This reduces the density of the material. The first laser beam 17*a* is obtained from, for example, a YAG laser unit. Then, the weak plasma is irradiated with the second laser beam 17*b* (main laser pulse). The second laser beam 17*b* is obtained from the $CO_2$ laser unit.

The pre-pulse reduces the density of the material. Thus, the absorption of the $CO_2$ laser beam, which is the main laser pulse, by the material is improved. This enhances the EUV radiation intensity.

Also, the density of the plasma becomes relatively low. Thus, the re-absorption of the EUV radiation decreases. Accordingly, the EUV generation efficiency increases, and generation of debris decreases.

LISTING OF REFERENCES

Patent Literature 1: Japanese Patent Application Laid-open Publications No. 2007-505460 or WO2005/025280

Patent Literature 2: Japanese Patent No. 4623192

Patent Literature 3: Japanese Patent Application Laid-open Publications No. 2005-17274

Patent Literature 4: Japanese Patent Application Laid-open Publications No. 2010-514214 or WO2008/088488

SUMMARY OF THE INVENTION

As described above, the DPP type (LAGDPP type) EUV light source device emits (directs) the second energy beam to the material on the electrode in the same area as the first energy beam. If the irradiation position (beam position on the electrode) of the second energy beam is deviated from a desired position, it becomes impossible to have a desired density of the plasma material (gas) that will be supplied to the discharge region. The desired density of the plasma material is the density suitable for the EUV radiation. Thus, it is important that the irradiation position of the second energy beam matches the irradiation position of the first energy beam. Of course, it is also important to ensure that the first energy beam is directed to the material on the electrode.

Conventionally, the irradiation position of the first energy beam and the irradiation position of the second energy beam are adjusted to match in the following manner. In the following description, the energy beam is the laser beam, and FIG. 10 is referred to.

Firstly, the first laser beam 17*a* emitted from the first laser source 12*a* is adjusted such that the first laser beam 17*a* is directed to a predetermined direction, and the second laser beam 17*b* emitted from the second laser source 12*b* is adjusted such that the second laser beam 17*b* is directed to a predetermined direction. The predetermined directions are those directions which are decided according to the design. The first laser beam 17*a* and the second laser beam 17*b* are designed to reach a predetermined position on the electrode 2*a*. The above-mentioned adjustments achieve the position matching between the irradiation position of the first laser beam 17*a* and the irradiation position of the second laser beam 17*b* on the electrode 2*a*. Thus, the predetermined position on the electrode 2*a* is irradiated with the first laser beam 17*a* and the second laser beam 17*b*.

Then, the EUV radiation is generated (EUV is caused to emit). Specifically, the electrodes 2*a* and 2*b* rotate, the high temperature plasma material 14 is transported to the discharge space, and the electric power is supplied across the two electrodes 2*a* and 2*b*. The first laser beam 17*a* is directed to the electrode 2*a*, and subsequently the second laser beam 17*b* is directed to the electrode 2*a*. The plasma is then generated. A large current that flows upon the discharge heats and excites the plasma. Thus, the EUV light is emitted.

The emitted EUV light (EUV output) is monitored, and the irradiation position of the second laser beam 17*b* is slightly adjusted to maximize the EUV output. This slight adjustment is the positioning (position matching) of the second energy beam to the first energy beam.

The positioning of the second laser beam 17*b* is performed while the EUV output is being monitored. The first direction of the position adjustment may not be always the correct direction. The first direction of the position adjustment may decrease the EUV output. If the first direction of the position adjustment decreases the EUV output, the position of the second laser beam 17*b* is returned to the original (initial) position, and then the second laser beam 17*b* is shifted to a different direction. As such, the positioning of the second laser beam 17*b* while the EUV output is being monitored is the trial-and-error approach. This is troublesome.

Also, the EUV radiation needs to be generated for the positioning of the second laser beam (beam position alignment between the first and second laser beams). Thus, an electric power should be supplied to the EUV light source for the beam position alignment between the first and second laser beams. This entails an additional cost.

In addition, if the EUV radiation does not take place even after the radiation directions of the first laser beam 17*a* and the second laser beam 17*b* are adjusted to the directions decided by the design (preset directions), it means that the electrode 2*a* is not irradiated with the first laser beam 17*a* and the second laser beam 17*b* (the first and second laser beams are not directed to the electrode 2*a*). To deal with this, firstly, the irradiation position of the first laser beam 17*a* should be adjusted while monitoring the EUV output. Subsequently, the irradiation position of the second laser beam 17*b* should be adjusted. These adjustments are also carried out on the trial-and-error approach. This increases the cost of the electric power spent for the EUV radiation.

In the case of the LPP type EUV light source device, the positioning (position alignment) of the first laser beam and the second laser beam is also important. In the following description, the LPP type EUV light source device will be described with reference to FIG. 12. The energy beam is the laser beam, which is similar to the foregoing description of the DPP type EUV light source device.

In FIG. 12, if the irradiation position of the first laser beam 17*a* shifts from the intended position, the liquid droplet of material 14 is not irradiated with the laser beam, and a weak plasma is not generated. As a result, if the material 14 is irradiated with the second laser beam 17*b*, the debris increases and the efficiency drops. If the irradiation position of the second laser beam 17*b* shifts from the intended position, the EUV radiation does not take place.

Thus, similar to the DPP type EUV light source device, matching the second laser beam irradiation position to the first laser beam irradiation position is important for the LPP type EUV light source device, and matching the first laser beam irradiation position to the liquid droplet material is important.

In the LPP type EUV light source device, when the position matching of the first and second laser beam 17*a* and 17*b* is performed, the actual EUV radiation is necessary. The EUV output is monitored, and the position of the first laser beam 17*a* and the position of the second laser beam 17*b* are adjusted to maximize the EUV output. Therefore, similar to the DPP type EUV light source device, the position matching is performed on the trial-and-error basis while the EUV output is being monitored. This is troublesome, and increases the cost of the electric power spent for the EUV light source device to emit the EUV light during the position matching.

In addition, if the EUV radiation does not take place even after the radiation directions of the first laser beam 17*a* and the second laser beam 17*b* are adjusted to the directions decided by the design (preset directions), it cannot be determined whether this is because the first laser beam 17*a* is deviated or the second laser beam 17*b* is deviated.

To deal with this, firstly, the irradiation position of the first laser beam 17*a* should be adjusted while monitoring the EUV output. Subsequently, the irradiation position of the second laser beam 17*b* should be adjusted. These adjustments are also carried out on the trial-and-error approach. This increases the cost of the electric power spent for the EUV radiation.

If the EUV radiation is not produced from the weak plasma, which is generated upon irradiation of the first laser beam, then a separate plasma monitor is needed. This complicates the apparatus configuration.

The present invention is proposed in view of the above-described problems. An object of the present invention is to provide an apparatus and a method for position alignment (position matching) between two energy beams, which can visualize the position alignment between the two energy beams, and achieve the position alignment in a short time. Another object of the present invention is to provide an apparatus and a method for position alignment (position matching) between two energy beams, that can reduce a cost of the electric power spent for a light source device during the position alignment.

According to one embodiment of the present invention, an apparatus for energy beam position alignment includes a movable mirror configured to reflect the second energy beam, and an optical unit configured to allow the first energy beam to pass therethrough, and to reflect the second energy beam reflected by the movable mirror and direct the second energy beam in a same direction as a travelling direction of the first energy beam. The apparatus for energy beam position alignment also includes a beam detecting unit configured to detect an incident position of an incident energy beam. The beam detecting unit may have an image detecting unit. The apparatus for energy beam position alignment also includes a movable branching unit configured to receive the first energy beam, which has passed through the optical unit, and the second energy beam, which is reflected by the optical unit. The branching unit is configured to branch a first part of the received energy beam, and guide the first part of the received energy beam toward a desired position (first position) on a material on the electrode, while passing a second part of the received energy beam and guiding the second part of the received energy toward the beam detecting unit.

The first and second energy beams are incident to the beam detecting unit via the branching unit. The beam incident position of each energy beam that is monitored (detected) by the beam detecting unit corresponds to a beam irradiation position on the material (or on the electrode) which is irradiated with each energy beam (first or second energy beam) directed to the material via the branching unit. Thus, the angle of the movable mirror is adjusted (controlled) to adjust the incident position of the second energy beam on the light detecting unit while the incident position of the first energy beam and the incident position of the second energy beam are being monitored (detected) by the beam detecting unit. This angle adjustment of the movable mirror (i.e., the incident position adjustment of the second energy beam on the light detecting unit) achieves the relative position alignment between the first energy beam and the second energy beam. By adjusting (controlling) the angle of the branching unit, the irradiation position of the first energy beam on the electrode and the irradiation position of the second energy beam on the electrode are adjusted. In other words, the position alignment between the first and second energy beams is carried out such that the material on the electrode is irradiated with both of the first and second energy beams.

The energy beam position alignment apparatus may include a polarized beam splitter which serves as the optical unit. The first energy beam, which is a polarized beam, may be incident to the polarized beam splitter, and the second energy beam, which is a polarized beam, may also be incident to the polarized beam splitter. The second energy beam may be polarized in a direction perpendicular to a polarized direction of the first energy beam. The polarized beam splitter may pass the first energy beam therethrough, and reflect the second energy beam. This configuration can reduce an amount of attenuation of each energy beam at the optical unit.

The energy beam position alignment apparatus may further include a movable lens between the optical unit and the branching unit. The movable lens may be configured to be movable in an optical axis direction for adjusting a first spot diameter of the first energy beam and a second spot diameter of the second energy beam. This configuration facilitates the adjustment of the spot diameter of each of the first and second energy beams on the optical unit.

The energy beam position alignment apparatus may further include a multi-layer body and a light detecting unit. The multi-layer body may have a diffuser plate and a wavelength conversion element. The multi-layer body may be disposed on a light incident side of the image detecting unit of the beam detecting unit. The multi-layer body may have a center opening that allows the incident energy beam to pass therethrough. The diffuser plate may be disposed closer to the image detecting unit than the wavelength conversion element. The center opening may have a diameter that allows both of the first and second energy beams to pass therethrough when the first and second energy beams have predetermined positional relationship. The light detecting unit may be disposed in the vicinity of the multi-layer body and configured to detect presence/absence of a diffused light, which is emitted from the multi-layer body. The light detecting unit may determine whether the irradiation position of the first energy beam and the irradiation position of the second energy beam no longer have the desired positional relationship.

According to one aspect of the present invention, there is provided an improved apparatus for energy beam position alignment. The apparatus is configured to be used with a light source device having a first energy beam radiation unit for emitting a first energy beam and a second energy beam radiation unit for emitting a second energy beam. The light source device is adapted to irradiate a material of extreme ultraviolet radiation with the first energy beam and to direct the second energy beam to or in the vicinity of a first position on the material, which is irradiated with the first energy beam, thereby exciting the material, producing plasma and extracting extreme ultraviolet light from the plasma. The apparatus is configured to align a second position on the material, which is irradiated with the second energy beam, with the first position. The apparatus includes an optical unit configured to allow the first energy beam emitted from the first energy beam radiation unit to pass therethrough, and to reflect the second energy beam emitted from the second energy beam radiation unit and direct the second energy beam in a same direction as a travelling direction of the first energy beam. The apparatus also includes a movable mirror configured to reflect the second energy beam and guide the second energy beam toward the optical unit. The apparatus also includes a beam detecting unit configured to detect an incident position of an incident energy beam (the first energy beam and the second energy beam) on the beam detecting unit. The apparatus also includes a branching unit configured to be movable and receive the first energy beam which has passed the optical unit and the second energy beam which is reflected by the optical unit. The branching unit is configured to branch a first part of the received first energy beam, and guide the first part of the received first energy beams toward the first position, while passing a second part of the received first energy beam and guiding the second part of the received first energy toward the beam detecting unit. The branching unit is configured to branch a third part of the received second energy beam and guide the third part of the received second energy beam toward the second position while passing a fourth part of the received second energy beam and guiding the fourth part of the received second energy beam toward the beam detecting unit.

The movable mirror is configured to be able to adjust an incident position of the second energy beam on the optical unit upon adjustment of a first angle of the movable mirror. The branching unit is configured to be able to adjust the first position of the first energy beam on the material and the second position of the second energy beam on the material upon adjustment of a second angle of the branching unit.

The apparatus for energy beam position alignment includes the movable mirror to reflect the second energy beam, and the optical unit to transmit the first energy beam, and reflect and guide the second energy beam in the same direction as the travelling direction of the first energy beam. The apparatus also includes the beam detecting unit to detect the incident position of the incident energy beam. The apparatus also includes the movable branching unit to receive the first energy beam, which has passed the optical unit, and the second energy beam, which has been reflected by the optical unit. The branching unit branches the first part of the received first energy beam, and guides it toward a first position on the material. The branching unit also transmits the second part of the first energy beam and guides it toward the beam detecting unit. The branching unit branches the third part of the received second energy beam, and guides it toward a second position on the material. The branching unit also transmits the fourth part of the first energy beam and guides it toward the beam detecting unit. The apparatus regulates (adjusts) the angle of the movable mirror while monitoring the incident positions of the first and energy beams by the beam detecting unit, in order to adjust the incident position of the second energy beam on the optical unit. The apparatus also regulates the angle of the branching unit to align the second position (irradiation position) of the second energy beam with the first position (irradiation position) of the first energy beam on the material. Accordingly, it is possible to easily achieve the matching between the irradiation position of the second energy beam and the irradiation position of the first energy beam, without generating UV radiation. In particular, because the EUV radiation is not necessary for the position alignment (position matching) between the first and second energy beams, it is possible to reduce a cost of the electric power spent for the EUV light source device, as compared to the conventional arrangement.

The apparatus for energy beam position alignment may further include a polarizing unit upstream of the optical unit. The optical unit may include a polarized beam splitter. The first energy beam incident to the polarized beam splitter may be a first polarized beam, and the second energy beam incident to the polarized beam splitter may be a second polarized beam. The polarizing unit may be configured to polarize the second energy beam in a direction perpendicular to a polarized direction of the first energy beam. The polarized beam splitter may pass the first energy beam which is incident to the polarized beam splitter, and reflect the second energy beam.

The optical unit includes the polarized beam splitter. The first and second energy beams incident to the polarized beam splitter are the polarized beams. Also, the polarizing unit is provided upstream of the polarized beam splitter to polarize the second energy beam in a direction perpendicular to the polarizing direction of the first energy beam. Therefore, it is possible to reduce an amount of attenuation in the energy beam at the optical unit. This improves the efficiency of the optical unit.

The apparatus for energy beam position alignment may further include a movable lens between the optical unit and the branching unit. The movable lens may be configured to be movable in an optical axis direction for adjusting a first spot diameter of the first energy beam and a second spot diameter of the second energy beam.

The movable lens is provide between the optical unit and the branching unit for adjusting the spot diameters of the first and second energy beams. The movable lens can move in the optical axial direction. Therefore, it is possible to easily adjust the spot diameters of the first and second energy beams on the optical unit.

The beam detecting unit may include an image detecting unit configured to capture an image of the incident energy beam to detect the incident position of the incident energy beam.

The image detecting unit is provided as the beam detecting unit. The beam detecting unit (image detecting unit) detects the irradiation position of the first energy beam on the optical unit, and the irradiation position of the second energy beam on the optical unit. Then, it is possible to display the position information of the first and second energy beams on the monitor. Accordingly, it is possible to know the accurate direction of the position adjustment without generating the EUV radiation. The irradiation position alignment of the second energy beam with the first energy beam can therefore be made in a shorter time, as compared to the conventional arrangement.

The apparatus for energy beam position alignment may further include a multi-layer body and a light detecting unit. The multi-layer body may have a diffuser plate and a wavelength conversion element. The multi-layer body may be disposed on a light incident side of the image detecting unit. The multi-layer body may have an opening at a center of the multi-layer body, and the opening may be configured to allow the incident energy beam to pass therethrough. The diffuser plate may be disposed closer to the image detecting unit than the wavelength conversion element. The opening may have a diameter that allows both of the first and second energy beams to pass therethrough when the first and second energy beams have predetermined positional relationship. The light detecting unit may be disposed in the vicinity of the multi-layer body and configured to detect presence and absence of a diffused light, which is emitted from the multi-layer body, and determine whether the irradiation position of the first energy beam and the irradiation position of the second energy beam no longer have desired positional relationship on the image detecting unit (beam detecting unit).

The multi-layer body including the diffuser plate and the wavelength conversion element is provided on the light incident side of the image detecting unit. The multi-layer body has a center opening that transmits the first and second energy beams. The diffuser plate is closer to the image detecting unit than the wavelength conversion element. The opening has a diameter that transmits both of the first and second energy beams when the first and second energy beams have predetermined positional relationship. Because the light detecting unit is disposed adjacent to the multi-layer body to detect the presence/absence of a diffused light, which is emitted from the multi-layer body, it is possible to detect that the irradiation position of the first energy beam and/or the irradiation position of the second energy beam is deviated (offset) from the predetermined position.

Specifically, when the incident position of the first energy beam and/or the incident position of the second energy beam is deviated from the opening of the multi-layer body, and the first energy beam and/or the second energy beam arrives at the multi-layer body of the diffuser plate and the wavelength conversion element, then the diffused light is emitted from the multi-layer body and detected by the light detecting unit. Thus, it is possible to detect that the incident position (irradiation position) of the first energy beam and/or the second energy beam is deviated from the desired position.

Because the diameter of the opening of the multi-layer body is approximately equal to the predetermined diameter of the light condensing (light condensing diameter) of each of the first and second energy beams, it is possible to detect (determine) whether the spot diameter of the first energy beam and/or the second energy beam is within the predetermined light condensing diameter. When the spot diameter of the first energy beam and/or the second energy beam is equal to or greater than the predetermined light condensing diameter, the diffused light is emitted from the multi-layer body and detected by the light detecting unit. Accordingly, it is possible to detect a fact that the spot diameter of the first energy beam and/or the second energy beam becomes equal to or greater than the predetermined light condensing diameter.

According to another aspect of the present invention, there is provided a method for energy beam position alignment, for use with a light source device having a first energy beam radiation unit for emitting a first energy beam and a second energy beam radiation unit for emitting a second energy beam. The light source device is adapted to irradiate a material of extreme ultraviolet radiation with the first energy beam and to direct the second energy beam to or in the vicinity of a first position on the material, which is irradiated with the first energy beam, thereby exciting the material, producing plasma and extracting extreme ultraviolet light from the plasma. The method includes preparing an optical unit configured to allow the first energy beam to pass therethrough, and to reflect the second energy beam. The method also includes causing the first energy beam to be incident to the optical unit. The method also includes causing the first energy beam, which passes through the optical unit, to be incident to a movable branching unit and to be reflected by the movable branching unit. The method also includes guiding the reflected first energy beam toward a beam irradiation position on the material, and causing the branching unit to branch part of the first energy beam. The method also includes detecting said part of the first energy beam by a beam detecting unit, reflecting the second energy beam by a movable mirror, and causing the reflected second energy beam to be incident to the optical unit. The method also includes causing the second energy beam, which is reflected by the optical unit, to proceed in a substantially same direction as the first energy beam. The method also includes causing the second energy beam to be incident to the branching unit and to be reflected by the branching unit, and guiding the second energy beam toward the beam irradiation position on the material. The method also includes reflecting the second energy beam by the optical unit, and branching part of the reflected second energy beam by the branching unit. The method also includes detecting the branched part of the second energy beam by the beam detecting unit. The method also includes actuating the movable mirror and the branching unit, based on a detection result obtained from the beam detecting unit, such that a second position on the material, which is irradiated with the second energy beam, has predetermined positional relationship with the first position of the first energy beam.

The method regulates (adjusts) the angle of the movable mirror while monitoring the incident positions of the first and energy beams by the beam detecting unit, in order to adjust the incident position of the second energy beam on the optical unit. The method also regulates the angle of the branching unit to align the second position (irradiation position) of the second energy beam with the first position (irradiation position) of the first energy beam on the material. Accordingly, it is possible to easily achieve the matching between the irradiation position of the second energy beam and the irradiation position of the first energy beam, without generating UV radiation. In particular, because the EUV radiation is not necessary for the position alignment (position matching) between the first and second energy beams, it is possible to reduce a cost of the electric power spent for the EUV light source device, as compared to the conventional arrangement.

The method for energy beam position alignment may further include disposing a movable lens between the optical unit and the branching unit such that the movable lens is able to move in an optical axis direction. The method may also include detecting a first beam spot diameter of the first energy beam by the beam detecting unit, and detecting a second beam spot diameter of the second energy beam by the beam detecting unit. The method may also include actuating the movable lens to cause the first beam spot diameter and the second beam spot diameter to become a predetermined value.

These and other objects, aspects and advantages of the present invention will become apparent to those skilled in the art from the following detailed description when read and understood in conjunction with the appended claims and drawings.

DETAILED DESCRIPTION OF THE INVENTION

Figure 1:
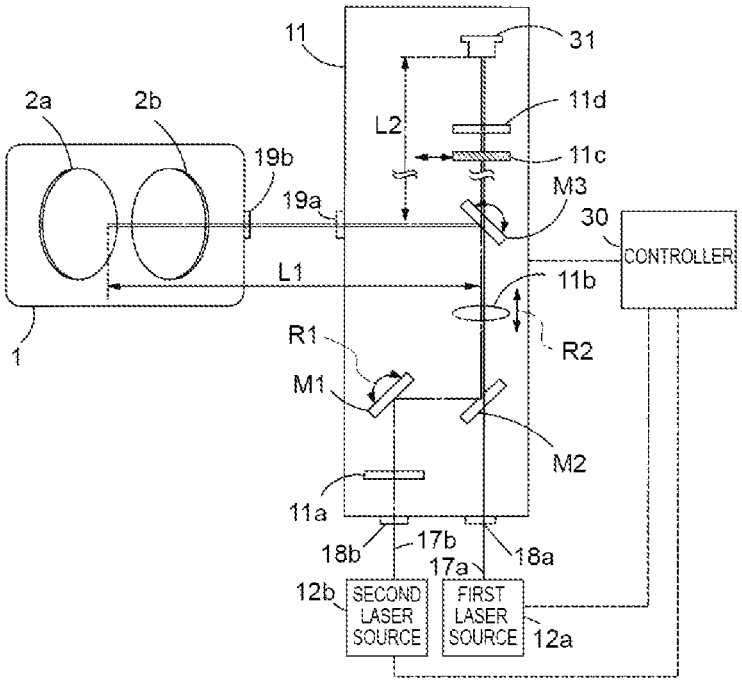
FIG. 1 illustrates an exemplary configuration of a position alignment apparatus according to an embodiment of the present invention together with a DPP type EUV light source device.

Referring to FIG. 1, an exemplary configuration of an apparatus for energy beam position alignment according to an embodiment of the present invention will be described. It should be noted that this position alignment apparatus may be referred to as an "alignment mechanism" in the following description.

In this embodiment, the DPP type EUV light source device will be described, and the energy beam used by the light source device is a laser beam.

A light source device includes a first laser source 12*a*, which is a first energy beam radiation unit. The first laser source 12*a* emits a first laser beam 17*a*, which is a first energy beam. For example, the first laser source 12*a* includes Nd:$YVO_4$ laser device. The light source device also includes a second laser source 12*b*, which is a second energy beam radiation unit. The second laser source 12*b* emits a second laser beam 17*b*, which is a second energy beam. For example, the second laser source 12*b* includes Nd:$YVO_4$ laser device.

An alignment chamber 11 houses a ½ wavelength plate 11*a*, a movable mirror M1, and a beam splitter M2. The beam splitter M2 is an optical unit (element). The ½ wavelength plate 11*a*, the movable mirror M1, and the beam splitter M2 are used to adjust the irradiation position of the first laser beam 17*a* and the irradiation position of the second laser beam 17*b* (will be described).

The alignment chamber 11 also houses a movable lens 11*b*, another movable mirror M3, an ND filter 11*d*, and a CCD 31. The CCD 31 is used as a unit for beam detection. The CCD 31 is an image detecting unit.

The movable lens 11*b*, the movable mirror M3, the ND filter 11*d*, and the CCD 31 are used to monitor the position adjustment between the first laser beam 17*a* and the second laser beam 17*b*, to adjust spot diameters of the first and second laser beams directed to an electrode 2*a*, and to adjust irradiation positions of the first and second laser beams on the electrode 2*a* (will be described). It should be noted that a light-shielding shutter 11*c* may be disposed on the light incident side of the ND filter 11*d* as shown in FIG. 1. The light-shielding filter 11*c* blocks the laser beam directed to the ND filter 11*d*.

The interior of the alignment chamber 11 is purged by, for example, dry nitrogen or cleaning dry air (CDA). Such purging is performed to prevent fogging (misting) up of a surface of each optical element housed in the alignment chamber 11 due to moisture or the like.

The first laser source 12*a* emits, for example, an S-polarized Nd:$YVO_4$ laser beam at a wavelength of 1064 nm. In the following description, the Nd:$YVO_4$ laser beam emitted from the first laser source 12*a* is referred to as a first laser beam 17*a*.

The first laser beam 17*a* passes through a window 18*a* of the alignment chamber 11 and arrives at the beam splitter M2. The beam splitter M2 is a polarized beam splitter, and is configured to, for example, pass an S polarized light component and reflect a P polarized light component. The first laser beam 17 is S polarized light. Thus, the first laser beam 17*a* passes through the beam splitter M2 and is guided to the movable lens 11*b*.

The polarized beam splitter includes, for example, a synthetic quartz substrate and a dielectric multi-layer polarizing film applied on the surface of the synthetic quartz substrate.

The second laser beam 17*b* passes through a window 18*b* of the alignment chamber 11 and arrives at the ½ wavelength plate 11*a*. The second laser beam 17*b* becomes the p polarized beam after the second laser beam 17*b* passes through the ½ wavelength plate 11*a*. The ½ wavelength plate 11*a* is, for example, a quartz wavelength plate.

The second laser beam 17*b*, which passes through the ½ wavelength plate 11*a* and becomes the p polarized beam, is reflected by the movable mirror M1 and arrives at the beam splitter M2. As described above, the second laser beam 17*b* is the p polarized beam, and therefore the second laser beam 17*b* is reflected by the beam splitter M2 and guided to the movable lens 11*b*. The movable mirror M1 is rotatable (turnable) in the directions as shown by the double arrow R1 in FIG. 1. The movable mirror M1 is used to adjust the irradiation position of the second laser beam 17*b* on the beam splitter M2 (will be described).

The first laser beam 17*a* and the second laser beam 17*b*, both of which are introduced to the movable lens 11*b*, pass through the movable lens 11*b* and arrives at the movable mirror M3. The movable mirror M3 is a branching unit. The movable lens 11*b* is linearly movable as indicated by the double arrow R2 in FIG. 1. The movable lens 11*b* is used to adjust the spot diameter of the first laser beam 17*a* and the stop diameter of the second laser beam 17*b* (will be described). The movable mirror M3 reflects part of the incident first laser beam 17*a* and part of the incident second laser beam 17*b*, and transmits the remaining part of the first laser beam 17*a* and the remaining part of the second laser beam 17*b*. The first and second laser beams 17*a* and 17*b* reflected by the movable mirror M3 pass through a window 19*a* of the alignment chamber 11, and are incident to a window 19*b* of the chamber 1. Then, the first and second laser beams 17*a* and 17*b* are guided to one of the two electrodes 2*a* and 2*b* (e.g., electrode 2*a*). The electrode 2*a* is a cathode. Thus, the cathode 2*a* is irradiated with the first and second laser beams 17*a* and 17*b*.

On the other hand, the first and second laser beams 17*a* and 17*b*, which passes through the movable mirror M3, arrive at the ND filter 11*d*. The ND filter 11*d* attenuates the intensity of each of the first and second laser beams 17*a* and 17*b*. The first and second laser beams 17*a* and 17*b* are then incident to the CCD 31. The ND filter 11*d* is configured to attenuate the intensities of the first and second laser beams 17*a* and 17*b*, which are incident to the CCD 31, such that the attenuated intensities are acceptable at the incident surface of the CCD 31.

The CCD 31 supplies position information of the first laser beam 17*a* and position information of the second laser beam 17*b* to a monitor (not shown) as the first and second laser beams 17*a* and 17*b* are incident to the CCD 31. The position information is information that indicates a position of the laser beam on the incident surface of the CCD 31.

In this embodiment, an optical path length L1 from the laser beam incident position on the movable mirror M3 to the laser beam irradiation position on the electrode 2*a* (2*b*) is equal to an optical path length L2 from the laser beam incident position on the movable mirror M3 to the laser beam incident surface of the CCD 31.

The light-shielding shutter 11*c* is disposed on the light incident side of the ND filter 11*d*. The light-shielding shutter 11*c* shields the ND filter 11*d* from the laser beams after the alignment is completed. Therefore, when the EUV radiation takes place, the laser beams do not reach the ND filter 11*d* and the CCD 31 so that it is possible to suppress the deterioration of the ND filter 11*d* and the CCD 31.

Figure 2A:
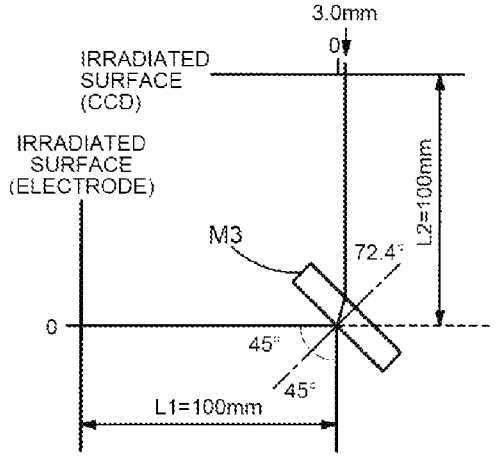
FIG. 2A illustrates one example of the correlation between a position of a laser beam on an electrode and a position of the laser beam on a light incident surface of a CCD in the position alignment apparatus of FIG. 1.
Figure 2B:
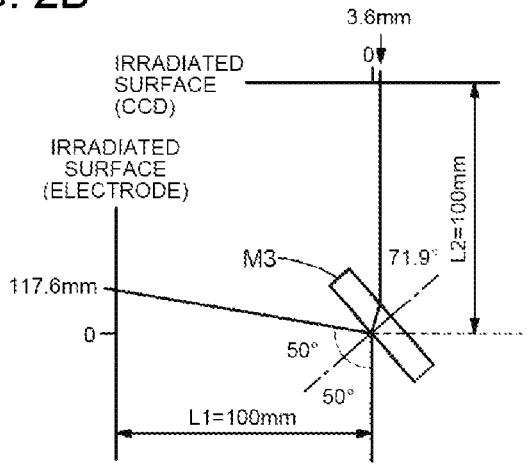
FIG. 2B illustrates another example of the correlation between the position of the laser beam on the electrode and the position of the laser beam on the light incident surface of the CCD in the position alignment apparatus of FIG. 1.

FIGS. 2A and 2B illustrate the relationship between the laser beam position on the electrode 2*a* (2*b*) and the laser beam position on the incident surface of the CCD 31.

In this embodiment, the wavelength of the laser beam is 1064 nm. The movable mirror M3 is made from synthetic quartz and a thickness t of the movable mirror M3 is 5 mm. The refractive index n of the movable mirror M3 is 1.449. The transmittance (light permeability) to the wavelength of 1064 nm is 94% when the thickness t is 5 mm.

The optical path length L1 from the laser beam incident position on the movable mirror M3 to the laser beam irradiation position on the electrode 2*a* (2*b*) is 100 mm, and the optical path length L2 from the laser beam incident position on the movable mirror M3 to the laser beam incident surface of the CCD 31 is also 100 mm.

In FIG. 2A, the optical axis of the laser beam reflected by the movable mirror M3, among the entire laser beam incident to the movable mirror M3 at the incident angle of 45 degrees, meets the irradiation (irradiated) surface of the electrode 2*a* (2*b*), and this crossing point is taken as the original point "0." Likewise, the optical axis of the laser beam incident to the movable mirror M3 meets the light incident surface of the CCD 31 (irradiation (irradiated) surface of the CCD 31), and this crossing point is taken as the original point "0."

As depicted in FIG. 2A, the laser beam, which is incident to the movable mirror M3 at the incident angle of 45 degrees and passes through the movable mirror M3, is refracted twice before reaching the irradiation surface of the CCD 31. On the irradiation surface of the CCD 31, there is a deviation of 3 mm between the landing point of the laser beam and the original point "0."

As shown in FIG. 2B, on the other hand, when the laser beam is incident to the movable mirror M3 at the incident angle of 50 degrees, and passes through the movable mirror M3, there is a deviation of 3.6 mm on the irradiation surface of the CCD 31 between the landing position of the laser beam and the original point "0." On the irradiation surface of the electrode 2*a* (2*b*), there is a deviation of 117.6 mm between the landing position of the laser beam, which is reflected by the movable mirror M3, and the original point "0" of the electrode 2*a* (2*b*).

As described above, it is possible to uniquely correlate the irradiation position of the laser beam on the electrode 2*a* (2*b*) with the laser beam position on the monitor of the CCD 31.

Figure 3A:
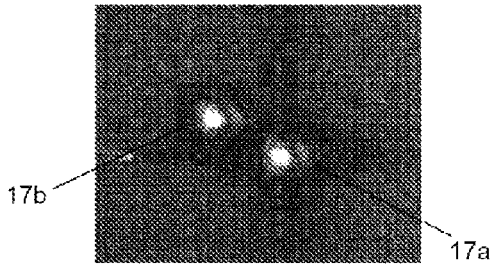
FIG. 3A is a photograph showing one example of position information of the first and second laser beams displayed on a monitor.
Figure 3B:
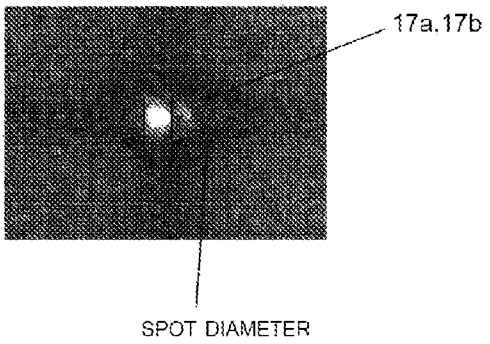
FIG. 3B is a photograph showing another example of the position information of the first and second laser beams displayed on the monitor.

FIGS. 3A and 3B show examples of the monitor screens of the CCD 31, which displays the position information of the first laser beam 17*a* and the position information of the second laser beam 17*b* on the monitor screen. The position information is produced from the CCD 31. FIG. 3A shows the first and second laser beams 17*a* and 17*b* before the position alignment, and FIG. 3B shows the first and second laser beams after the position alignment.

The correlation between the position of the first laser beam 17*a* on the monitor screen, shown in each of FIGS. 3A and 3B, and the irradiation position of the first laser beam 17*a* on the electrode 2*a* (cathode) is decided and known beforehand.

As the movable mirror M1 moves in the alignment chamber 11, the incident position of the second laser beam 17*b* on the beam splitter M2 moves, the incident position of the second laser beam 17*b* on the movable mirror M3 moves, and the incident position of the second laser beam 17*b* on the ND filter 11*d* moves. The incident position of the second laser beam 17*b* on the CCD 31 also moves. Also, the incident position of the second laser beam 17*b* on the electrode 2*b* (cathode) moves when the second laser beam 17*b* is reflected by the movable mirror M3 and incident to the electrode 2*a* (cathode).

Thus, when the first and second laser beams 17*a* and 17*b* take the positions as shown in FIG. 3A, the movable mirror M1 is adjusted to shift the position of the second laser beam 17*b* to the position of the first laser beam 17*a* on the monitor screen. As a result, as shown in FIG. 3B, the second laser beam 17*b* overlaps the first laser beam 17*a*. In this manner, the position adjustment is carried out such that the irradiation position of the first laser beam 17*a* on the electrode 2*a* (2*b*) coincides with the irradiation position of the second laser beam 17*b*. Therefore, the material 14 on the discharge electrode 2*a* is irradiated with the first energy beam 17*a* and also irradiated with the second laser beam 17*b*. In other words, the material 14 is situated in an area that is irradiated with the first energy beam, and the irradiation position of the second energy beam on the discharge electrode 2*a* (2*b*) is adjusted such that the same area is irradiated with the second energy beam 17*b*.

It should be noted that the position matching (adjustment, alignment) of the irradiation position of the second energy beam may be performed by an operator who watches the monitor. The operator watches the monitor, and actuates the movable mirror M3 for the position matching of the irradiation position of the second energy beam. Alternatively, the controller 30 may calculate the difference between the detected position, which is obtained from the CCD 31, and the target position, and may actuate the movable mirror M3 based on the calculated difference.

After the position of the second laser beam 17*b* is adjusted, the position of the movable lens 11*b* is adjusted to adjust the spot diameter of the first laser beam 17*a* and the spot diameter of the second laser beam 17*b*. As described above, the optical path length L1 from the laser beam incident position on the movable mirror M3 to the laser beam irradiation position on the electrode 2*a* (2*b*) is equal to the optical path length L2 from the laser beam irradiation position on the movable mirror M3 to the laser beam incident position on the CCD 31. Thus, the spot diameter of the first laser beam 17*a* on the incident surface of the CCD 31 is equal to the stop diameter of the first laser beam 17*a* on the electrode 2*a* (2*b*), and the spot diameter of the second laser beam 17*b* on the incident surface of the CCD 31 is equal to the stop diameter of the second laser beam 17*b* on the electrode 2*a* (2*b*).

It should be noted that the adjustment of the spot diameter of each of the first laser beam 17*a* and the second laser beam 17*b* may be performed by an operator who watches the monitor. The operator watches the monitor, and actuates the movable lens 11*b* for the adjustment of the spot diameter of the laser beam. Alternatively, the controller 30 may calculate the difference between the detected spot diameter of each of the laser beams, which is obtained from the CCD 31, and the target spot diameter, which is stored in the controller 30 beforehand, and may actuate the movable lens 11*b* based on the calculated difference.

Figure 4:
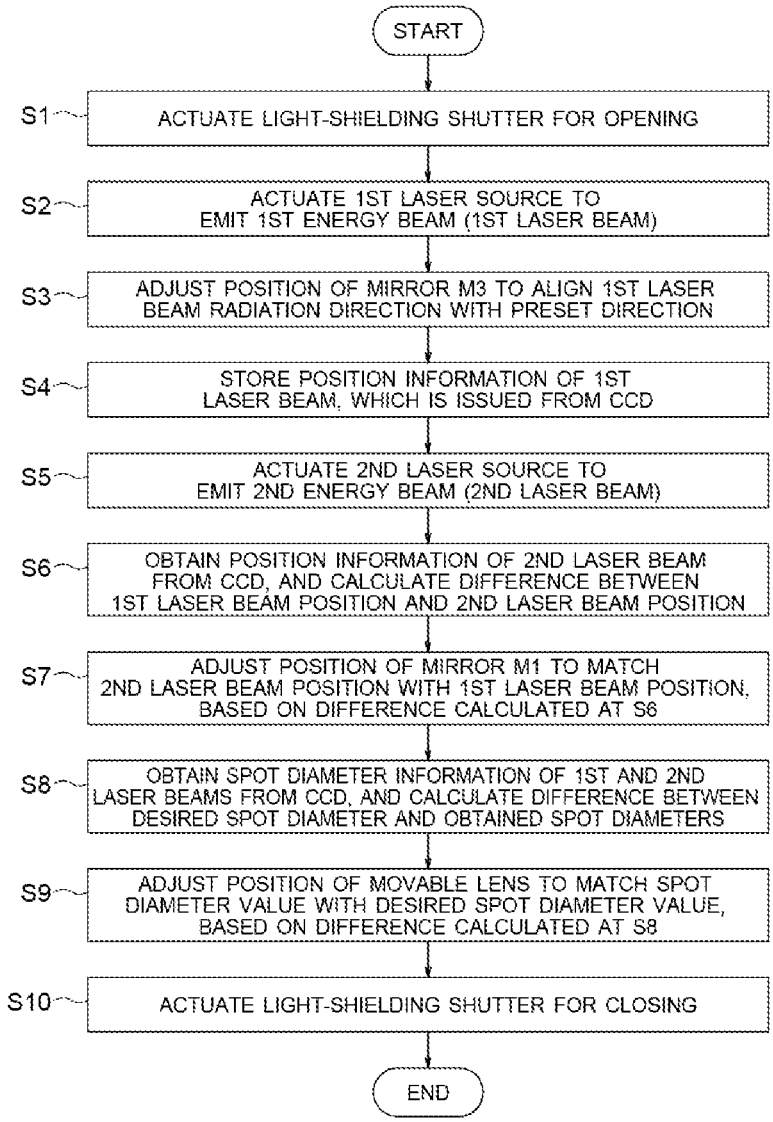
FIG. 4 is a flowchart of a process for position alignment between the first laser beam and the second laser beam in the position alignment apparatus shown in FIG. 1.

Referring to FIG. 4, an exemplary procedure for the position alignment of the second energy beam to the first energy beam by means of the alignment mechanism of the embodiment will be described. In the following example, the controller 30 is used to carry out the position alignment. It should be noted that the controller 30 stores data of the target spot diameter of the first laser beam 17*a* and data of the target spot diameter of the second laser beam 17*b* beforehand.

Firstly, the controller 30 actuates the light-shielding shutter 11*c* to an open condition (Step S1). Then, the controller 30 actuates the first laser source 12*a* and causes the first laser source 12*a* to emit the first laser beam (first energy beam) 17*a* (Step S2). The controller 30 then adjusts the position of the movable mirror M3 such that the irradiation direction of the first laser beam 17*a* coincides with the preset direction, which is decided by the design (Step S3). It should be noted that if the irradiation position of the first laser beam 17*a* on the electrode 2*a* should be adjusted more precisely, the EUV radiation may be generated and the EUV output is monitored. Then, the position of the movable mirror M3 may be adjusted to maximize the EVU output.

Subsequently, the controller 30 stores the position information of the first laser beam 17*a*, which is obtained from the CCD 31 (Step S4). The stored position information represents the irradiation position of the first laser beam 17*a* on the electrode 2*a*.

As long as the positional relationship between the electrode 2*a* and the alignment mechanism is unchanged, the position information of the first laser beam 17*a* is unchanged. When the irradiation position of the first laser beam 17*a* is re-adjusted, the position of the movable mirror M3 is adjusted such that the irradiation position of the first laser beam 17*a* coincides with the stored irradiation position of the first laser beam 17*a*, without generating the EUV radiation. This enables the precise adjustment of the irradiation position of the first laser beam 17*a* on the electrode 2*a*.

Then, the controller 30 actuates the second laser source 12*b*, and causes the second laser source 12*b* to emit the second laser beam 17*b*, i.e., the second energy beam (Step S5). The controller 30 obtains the position information of the second laser beam 17*b*, which is issued from the CCD 31. The controller 30 calculates the difference between the position of the first laser beam 17*a* and the position of the second laser beam 17*b* (Step S6). Based on the difference calculated at Step S6, the controller 30 adjusts the position of the movable mirror M1 such that the position of the second laser beam 17*b* coincides with the position of the first laser beam 17*a* (Step S7). As a result, the position adjustment is performed such that the irradiation position of the second laser beam 17*b* matches the irradiation position of the first laser beam 17*a* on the electrode 2*a*. In other words, the irradiation position of the second energy beam is adjusted such that the material 14 on that position (area) on the discharge electrode 2*a* which is irradiated with the first energy beam is also irradiated with the second energy beam.

Subsequently, the controller 30 obtains the spot diameter information of the first and second laser beams 17*a* and 17*b* from the CCD 31. The controller 30 calculates the difference between the target spot diameter, which is stored in advance, and the obtained spot diameter (Step S8). Based on the difference calculated at Step S8, the controller 30 adjusts the position of the movable lens 11*b* such that the value of the spot diameter obtained from the CCD 31 becomes equal to the value of the target spot diameter (Step S9). As a result, the spot diameter adjustment is made such that the spot diameter of each of the first and second laser beams 17*a* and 17*b* on the electrode 2*a* becomes equal to the predetermined size. The predetermined size is a size of the spot diameter that maximizes the output of the EUV light when the material 14 on the electrode 2*a* is irradiated with the laser beam and evaporated.

After that, the controller 30 actuates the light-shielding shutter 11*c* to a closed condition (Step S10).

As described above, use of the alignment mechanism of the embodiment enables the alignment of the irradiation position of the second energy beam with the irradiation position of the first energy beam on the electrode 2*a*, without generating the EUV radiation.

The information of the irradiation position of the first energy beam and the irradiation position of the second energy beam is displayed on the monitor. Thus, it is possible to know the accurate (correct) position adjustment direction from the beginning. As compared to the conventional arrangement, it is possible to perform the position alignment of the irradiation position of the second energy beam in a shorter time. Because the EUV radiation is not necessary to perform the position alignment of the irradiation position of the second energy beam, it is possible to reduce a cost of the electric power to be spent for the EUV light source, as compared to the conventional arrangement.

With the alignment mechanism of the embodiment, it is also possible to easily adjust the spot diameter of each of the first and second energy beams.

It should be noted that although the DPP type EUV light source device is described in the foregoing, application of the present invention is not limited to the DPP type EUV light source device. For example, the alignment mechanism of the present invention may be used for the LPP type EUV light source device.

Figure 5:
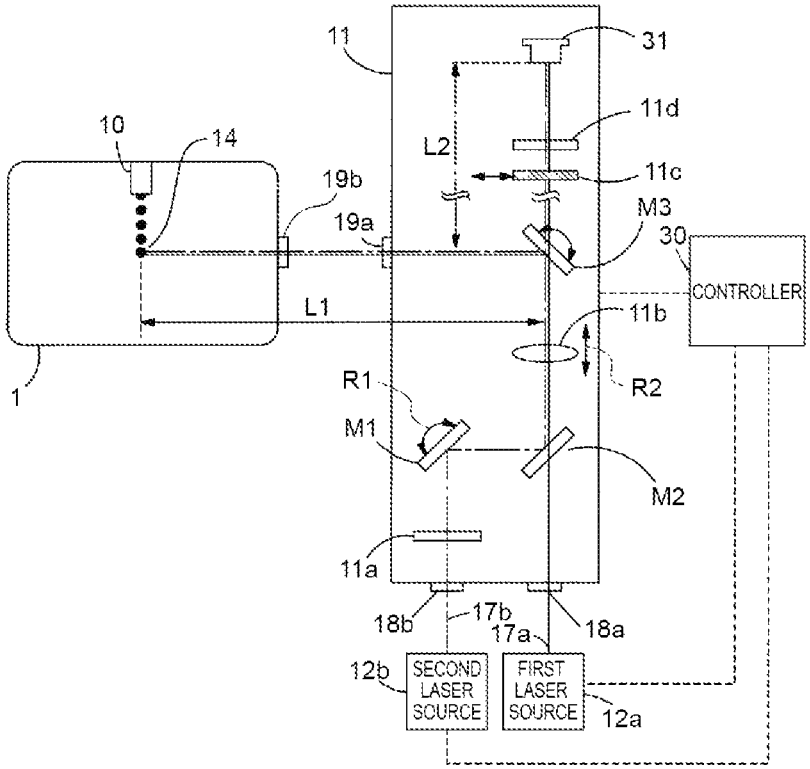
FIG. 5 illustrates an exemplary configuration of a position alignment apparatus according to another embodiment of the present invention when it is used with an LPP type EUV light source device.

FIG. 5 illustrates another alignment mechanism that is used for the LPP type EUV light source device. Fundamentally, this alignment mechanism has a similar structure to the one shown in FIG. 1, and the redundant description will not be made. The alignment mechanism shown in FIG. 5 is configured to align the first laser beam 17*a* and the second laser beam 17*b* with the material 14, which has a liquid droplet shape. The material 14 is supplied from a material feed unit 10.

Figure 6:
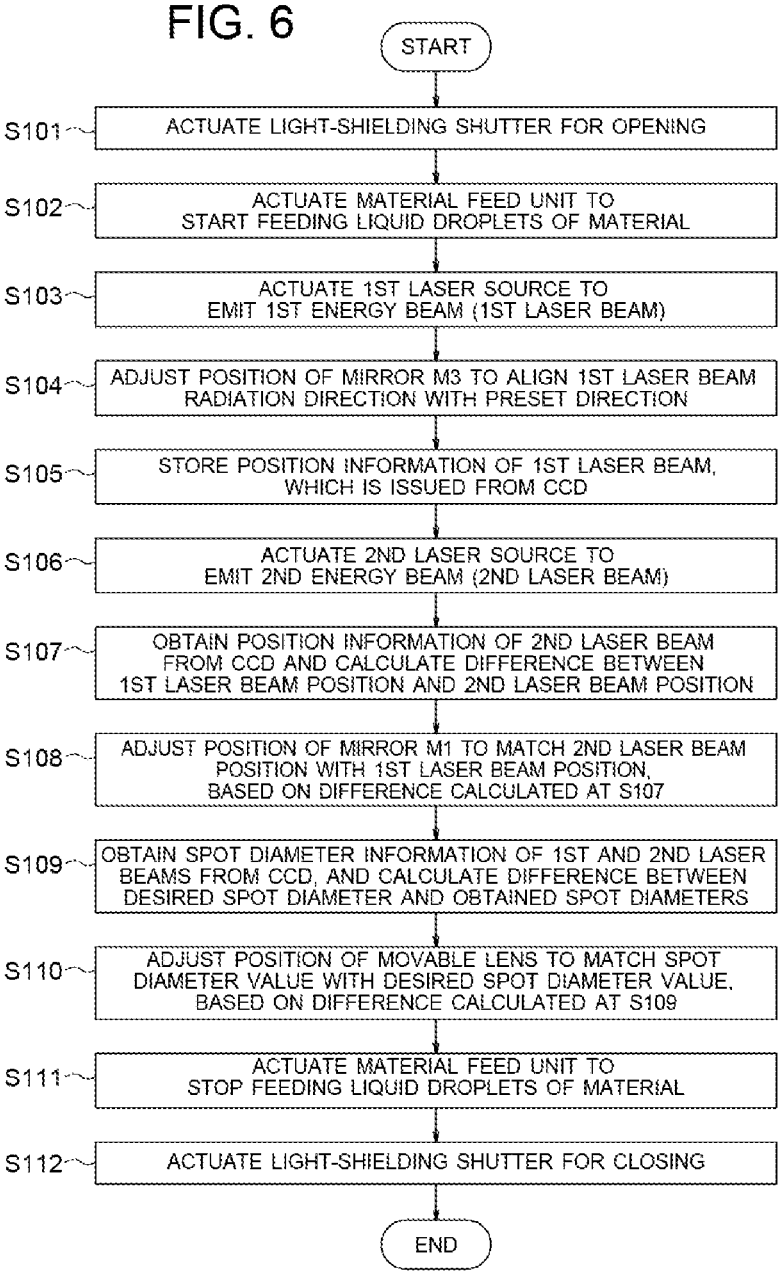
FIG. 6 is a flowchart of a process for position alignment between the first laser beam and the second laser beam in the position alignment apparatus shown in FIG. 5.

Referring to FIG. 6, the procedure for position alignment of the first and second energy beams by means of the alignment mechanism shown in FIG. 5 will be described. In the following description, the controller 30 performs the position alignment. The controller 30 stores data of the target spot diameter of the first laser beam (first energy beam) 17*a* and the target spot diameter of the second laser beam (second energy beam) 17*b* in advance.

Firstly, the controller 30 actuates the light-shielding shutter 11*c* to an open condition (Step S101). Then, the controller 30 actuates the material feed unit 10 to start feeding the liquid droplet of material 14 (Step S102).

The controller 30 actuates the first laser source 12*a* and causes the first laser source 12*a* to emit the first laser beam (first energy beam) 17*a* (Step S103). The controller 30 then adjusts the position of the movable mirror M3 such that the irradiation direction of the first laser beam 17*a* coincides with the preset direction, which is decided by the design (Step S104). It should be noted that if the irradiation position of the first laser beam 17*a* on the liquid droplet of material 14 should be adjusted more precisely, presence/absence of a weak plasma may be monitored by a separate plasma monitor. Then, the position of the movable mirror M3 may be adjusted to generate the weak plasma.

Subsequently, the controller 30 stores the position information of the first laser beam 17*a*, which is obtained from the CCD 31 (Step S105). The stored position information represents the irradiation position of the first laser beam 17*a* on the liquid droplet of material 14.

As long as the positional relationship between the liquid droplet of material 14 and the alignment mechanism is unchanged, the position information of the first laser beam 17*a* is unchanged. When the irradiation position of the first laser beam 17*a* is re-adjusted, the position of the movable mirror M3 is adjusted such that the position of the first laser beam 17*a* coincides with the stored position of the first laser beam 17*a*, without using the plasma monitor. This enables the precise adjustment of the irradiation position of the first laser beam 17*a* on the liquid droplet of material 14.

Then, the controller 30 actuates the second laser source 12*b*, and causes the second laser source 12*b* to emit the second laser beam 17*b*, i.e., the second energy beam (Step S106). The controller 30 obtains the position information of the second laser beam 17*b*, which is issued from the CCD 31. The controller 30 calculates the difference between the position of the first laser beam 17*a* and the position of the second laser beam 17*b* (Step S107). Based on the difference calculated at Step S107, the controller 30 adjusts the position of the movable mirror M1 such that the position of the second laser beam 17*b* has a prescribed relationship with the position of the first laser beam 17*a* (Step S108). As a result, the position adjustment is performed such that the irradiation position of the second laser beam 17*b* on the liquid droplet of material 14 takes the prescribed relationship relative to the irradiation position of the first laser beam 17*a* on the liquid droplet of material 14.

For example, when the controller 30 adjusts the position of the movable mirror M1 to cause the position of the second energy beam 17*b* on the CCD 31 to coincide with the position of the first energy beam 17*a* on the CCD 31, the irradiation position of the second laser beam 17*b* on the liquid droplet of material 14 coincides with the irradiation position of the first energy beam 17*a* on the liquid droplet of material 14.

If the irradiation position on the liquid droplet of material 14 is different from the position of the weak plasma to a certain extent, the above-described positional relationship between the two laser beams reflects this difference.

As the controller 30 adjusts the position of the movable mirror M1 to cause the position of the second energy beam 17*b* on the CCD 31 to coincide with the position of the first energy beam 17*a* on the CCD 31, or correspond to the position of the first energy beam 17*a* on the CCD 31 based on the above-mentioned difference, then the position of the weak plasma, which is generated when the liquid droplet of material 14 is irradiated with the first laser beam 17*a*, is irradiated with the second laser beam 17*b*.

The controller 30 obtains the information about the spot diameters of the first and second laser beams 17*a* and 17*b*, which are issued from the CCD 31. The controller 30 calculates the difference between the target spot diameter, which is stored in the controller 30 beforehand, and the obtained spot diameter (Step S109). Based on the difference calculated at Step S109, the controller 30 adjusts the position of the movable lens 11*b* such that the value of the spot diameter obtained from the CCD 31 becomes equal to the value of the target spot diameter (Step S110). As a result, the spot diameter adjustment is made such that the spot diameter of each of the first and second laser beams 17*a* and 17*b* on the electrode 2*a* becomes equal to the predetermined size. As described above, the predetermined size is a size of the spot diameter that maximizes the output of the EUV light.

After that, the controller 30 actuates the material feed unit 10 to stop feeding the liquid droplet of material 14 (Step S111). The controller 30 also actuates the light-shielding shutter 11*c* to a closed condition (Step S112).

As described above, use of the alignment mechanism of the embodiment enables the alignment of the irradiation position of the second energy beam on the weak plasma with the irradiation position of the first energy beam on the liquid droplet of material 14.

The information of the irradiation position of the first energy beam and the irradiation position of the second energy beam is displayed on the monitor. Thus, it is possible to know the accurate (correct) position adjustment direction from the beginning. As compared to the conventional arrangement, it is possible to perform the position alignment of the irradiation position of the second energy beam in a shorter time. Therefore, it is possible to reduce a cost of the electric power to be spent for the EUV light source, as compared to the conventional arrangement.

With the alignment mechanism of the embodiment, it is also possible to easily adjust the spot diameter of each of the first and second energy beams.

Modification to the Above-Described Embodiment

Figure 7:
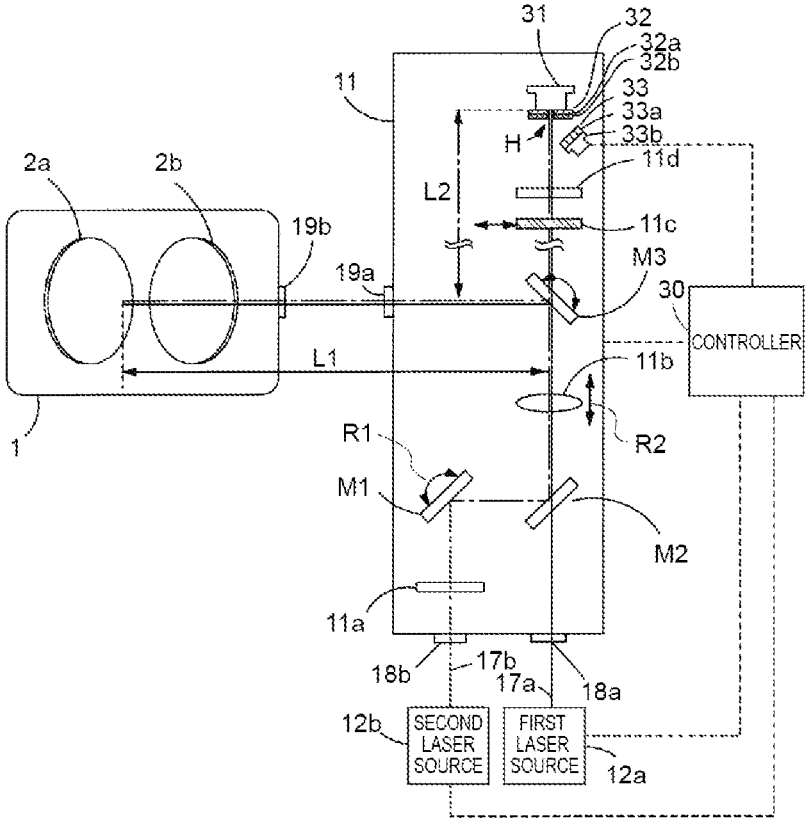
FIG. 7 illustrates an exemplary configuration of a position alignment apparatus according to a modified embodiment of the present invention.

Referring to FIG. 7, a modification to the above-described embodiment will be described.

In the above-described embodiment, the CCD 31 serves as the beam detection unit, and is used to obtain the position information of the first energy beam 17*a* and the position information of the second energy beam 17*b*. Then, the position alignment is carried out such that the position of the second energy beam 17*b* matches the position of the first energy beam 17*a*.

In the modification shown in FIG. 7, a diffuser plate 32*a* is provided in front of (upstream of) the CCD 31. The diffuser plate 32*a* has an opening (through hole) H that has a diameter similar to a condensed light diameter of the first laser beam 17*a* (or a condensed light diameter of the second laser beam 17*b*). In addition, a wavelength conversion element 32*b* is provided in front of the diffuser plate 32*a* for converting the wavelength of the laser beam to a desired wavelength. The wavelength conversion element 32*b* has an opening (through hole) H that has a diameter similar to a condensed light diameter of the laser beam. The wavelength conversion element 32*b* is, for example, a non-linear optical crystal. Thus, a multi-layer body 32, which includes the diffuser plate 32*a* having the opening (through hole) H and the wavelength conversion element 32*b* having the opening (through hole) H, is disposed between the CCD 31 and the movable mirror M3, i.e., on the light incident side of the CCD 31. The CCD 31 is used as the image detecting unit. In FIG. 7, the multi-layer body 32 (or the diffuser plate 32*a*) is in contact with the CCD 31.

Also, a light detecting unit 33 is disposed in the vicinity of the multi-layer body 32. The light detecting unit 33 includes a fundamental wave cut-off filter 33*a* and a second CCD 33*b*. The fundamental wave cut-off filter 33*a* allows the light, which is wavelength-converted by the wavelength conversion element 32*b*, to pass therethrough. The second CCD 33*b* disposed behind the fundamental wave cut-off filter 33*a* detects the light that has passed the fundamental wave cut-off filter 33*a*.

The center of the opening H of the diffuser plate 32*a* substantially coincides with the center of the opening H of the wavelength conversion element (non-linear optical crystal) 32*b* such that a single through hole is formed by the two openings H and H. The position of the opening H of the through hole on the CCD 31 is decided to correspond to the irradiation position of the first laser beam 17*a* on the electrode (cathode) 2*a*. The diffuser plate 32*a* is integral (united) to the wavelength conversion element 32*b*. It should be noted that the diffuser plate 32*a* of the multi-layer body 32 may not be united to the wavelength conversion element 32*b* of the multi-layer body 32. For example, the diffuser plate 32*a* and the wavelength conversion element 32*b* may be separate elements and may have a plate shape respectively. These plate elements 32*a* and 32*b* may be laminated one after another, or be spaced from each other at a predetermined distance.

Figure 8A:
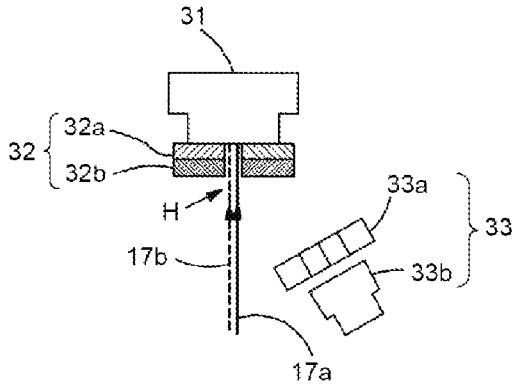
FIG. 8A is a view useful to describe a position alignment method that is carried out by the position alignment apparatus shown in FIG. 7.
Figure 8B:
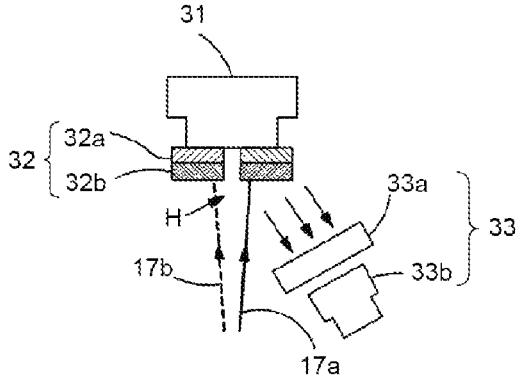
FIG. 8B is another view useful to describe the position alignment method that is carried out by the position alignment apparatus shown in FIG. 7.
Figure 9:
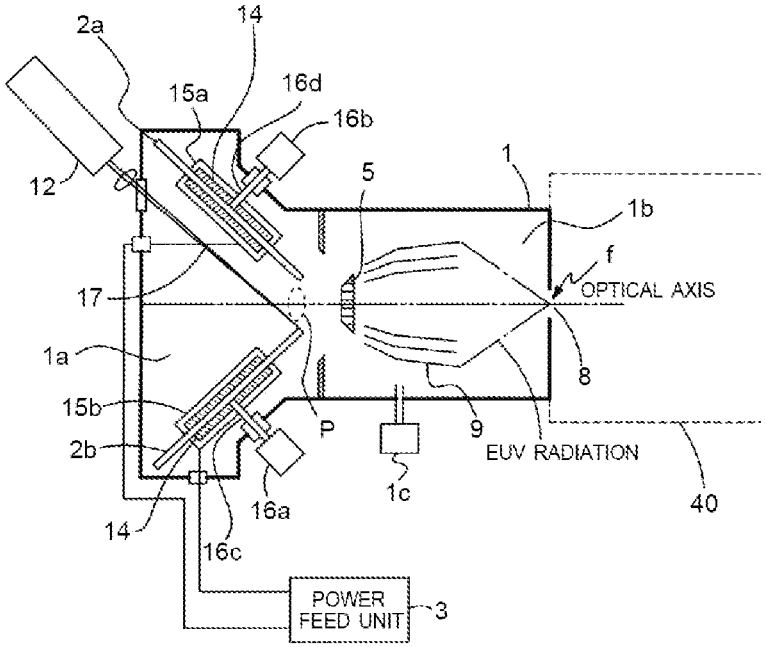
FIG. 9 schematically illustrates a DPP (LAGDPP) type EUV light source device.
Figure 10:
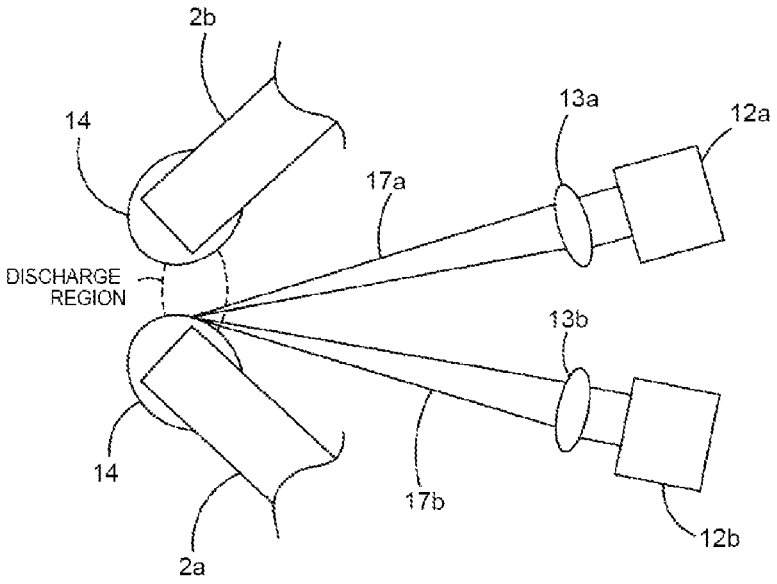
FIG. 10 illustrates an exemplary configuration of the DPP (LAGDPP) type EUV light source device that directs a first laser beam and a second laser beam to a material (tin).
Figure 11:
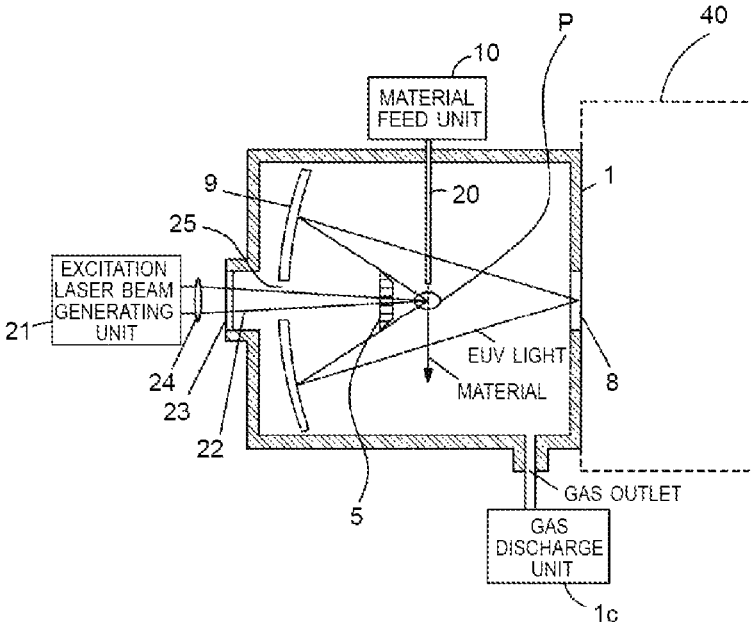
FIG. 11 schematically illustrates an LPP type EUV light source device.
Figure 12:
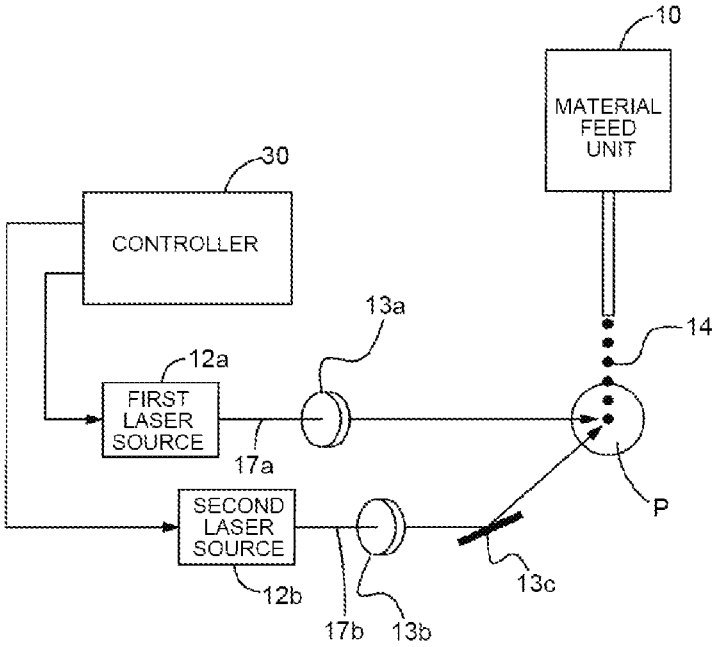
FIG. 12 illustrates an exemplary configuration of the LPP type EUV light source device that directs a first laser beam and a second laser beam to a material (tin).

Referring to FIGS. 8A and 8B, the position alignment in this modification will be described. FIG. 8A shows that the first laser beam 17*a* and the second laser beam 17*b* are aligned to a predetermined position. FIG. 8B shows that the first laser beam 17*a* and the second laser beam 17*b* are not at the predetermined position.

As illustrated in FIG. 8A, when the position of the first laser beam 17*a* is aligned to the predetermined position (the desired irradiation position of the first laser beam 17*a* on the electrode 2*a*), and the position of the second laser beam 17*b* is aligned to the position of the first laser beam 17*a*, then the first and second laser beams 17*a* and 17*b* pass through the openings H of the diffuser plate 32*a* and the wavelength conversion element 32*b* and arrives at the CCD 31.

On the other hand, as illustrated in FIG. 8B, when the position of the first laser beam 17*a* is not aligned to the predetermined position (the desired irradiation position of the first laser beam 17*a* on the electrode 2*a*), and/or the position of the second laser beam 17*b* is not aligned to the desired position, then part or all of the first and second laser beams 17*a* and 17*b* does not pass through the openings H of the diffuser plate 32*a* and the wavelength conversion element 32*b* and are incident to the multi-layer body 32 made from the diffuser plate 32*a* and the wavelength conversion element 32*b*.

This laser beam passes through the wavelength conversion element 32*b* for wavelength conversion, and arrives at the diffuser plate 32*a*. The laser beam, which arrives at the diffuser plate 32*a*, passes through the wavelength conversion element 32*b* again and becomes the diffused light. The diffused light is incident to the light detecting unit 33. The light detecting unit 33 is disposed at a position to receive the diffused light.

The light detecting unit 33 includes the fundamental wave cut-off filter 33*a* to allow the wavelength-converted light, which is obtained by cutting off the wavelengths of the first and second laser beams 17*a* and 17*b*, to pass therethrough. The light detecting unit 33 also includes the second CCD 33*b*. The diffused light is incident to the second CCD 33*b* via the fundamental wave cut-off filter 33*a*, and the second CCD 33*b* detects the diffused light (wavelength-converted light).

Thus, it is possible to determine whether or not the position of the first laser beam 17*a* and/or the position of the second laser beam 17*b* is deviated from the desired position, by monitoring whether or not the wavelength-converted light is detected by the light detecting unit 33.

When the wavelength of each of the first laser beam 17*a* and the second laser beam 17*b* is 1064 nm, the fundamental wave cut-off filter 33*a* becomes an IR cut-off filter that cuts off the light at the wavelength of 1064 nm.

With the above-described configuration, the positioning of the first laser beam 17*a* and the positioning of the second baser beam 17*b* are made (adjusted) such that no wavelength-converted light is detected by the second CCD 33*b*. With such positioning, the first and second laser beams take the desired position(s). It should be noted that the output of the light detecting unit 33 may be monitored while the apparatus (light source device) is operating. During this monitoring, when the light detecting unit 33 detects the deviation of the first (or second) laser beam position from the desired position, the light detecting unit 33 (or the light source device) may alarm.

Because the opening H of each of the diffuser plate 32*a* and the wavelength conversion element 32*b* has a size similar to the light condensing diameter of the first and second laser beams 17*a* and 17*b*, it is possible for the second CCD 33*b* to detect the wavelength-converted light if the spot diameter of each of the first and second laser beams on the CCD 31 is greater than the predetermined size as described above. Therefore, the size of the spot diameter can be adjusted based on the position information obtained from the second CCD 33*b*. It should be noted that an optical detecting element such as a photodiode may be used instead of the second CCD 33*b*.

While certain embodiments have been described, these embodiments have been presented by way of example only, and are not intended to limit the scope of the present invention. The novel apparatuses (devices) and methods thereof described herein may be embodied in a variety of other forms; furthermore, various omissions, substitutions and changes in the form of the apparatuses (devices) and methods thereof described herein may be made without departing from the gist of the present invention. The accompanying claims and their equivalents are intended to cover such forms or modifications as would fall within the scope and gist of the present invention.

The present application is based upon and claims the benefit of a priority from Japanese Patent Application No. 2014-083452, filed Apr. 15, 2014, and the entire contents of which are incorporated herein by reference.

What is claimed is:

1. An apparatus for energy beam position alignment, said apparatus being configured to be used with a light source device having a first energy beam radiation unit for emitting a first energy beam and a second energy beam radiation unit for emitting a second energy beam, said light source device being adapted to irradiate a material of extreme ultraviolet radiation with the first energy beam and to direct the second energy beam to or in the vicinity of a first position on the material, which is irradiated with the first energy beam, thereby exciting the material, producing plasma and extracting extreme ultraviolet light from the plasma, said apparatus configured to align a second position on the material, which is irradiated with the second energy beam, with the first position, said apparatus comprising:

an optical unit configured to allow the first energy beam emitted from the first energy beam radiation unit to pass therethrough, and to reflect the second energy beam emitted from the second energy beam radiation unit and direct the second energy beam in a same direction as a travelling direction of the first energy beam;

a movable mirror configured to reflect the second energy beam and guide the second energy beam toward the optical unit;

a beam detecting unit configured to detect an incident position of an incident energy beam thereon; and a branching unit configured to be movable and receive the first energy beam which has passed the optical unit and the second energy beam which is reflected by the optical unit, said branching unit being configured to branch a first part of the received first energy beam, and guide said first part of the received first energy beams toward said first position, while passing a second part of the received first energy beam and guiding the second part of the received first energy toward the beam detecting unit, said branching unit being configured to branch a third part of the received second energy beam and guide said third part of the received second energy beam toward said second position while passing a fourth part of the received second energy beam and guiding the fourth part of the received second energy beam toward the beam detecting unit, said movable mirror being configured to be able to adjust an incident position of the second energy beam on the optical unit upon adjustment of a first angle of said movable mirror, said branching unit being configured to be able to adjust the first position of the first energy beam on the material and the second position of the second energy beam on the material upon adjustment of a second angle of said branching unit.

2. The apparatus for energy beam position alignment according to claim 1 further including a polarizing unit upstream of the optical unit, and wherein the optical unit includes a polarized beam splitter, the first energy beam incident to the polarized beam splitter is a first polarized beam, the second energy beam incident to the polarized beam splitter is a second polarized beam, the polarizing unit is configured to polarize the second energy beam in a direction perpendicular to a polarized direction of the first energy beam, and the polarized beam splitter passes the first energy beam which is incident to the polarized beam splitter, and reflects the second energy beam.

3. The apparatus for energy beam position alignment according to claim 1 further including a movable lens between the optical unit and the branching unit, and configured to be movable in an optical axis direction for adjusting a first spot diameter of the first energy beam on the optical unit and a second spot diameter of the second energy beam on the optical unit.

4. The apparatus for energy beam position alignment according to claim 2 further including a movable lens between the optical unit and the branching unit, and configured to be movable in an optical axis direction for adjusting a first spot diameter of the first energy beam on the optical unit and a second spot diameter of the second energy beam on the optical unit.

5. The apparatus for energy beam position alignment according to claim 1, wherein the beam detecting unit includes an image detecting unit configured to capture an image of the incident energy beam to detect the incident position of the incident energy beam.

6. The apparatus for energy beam position alignment according to claim 2, wherein the beam detecting unit includes an image detecting unit configured to capture an image of the incident energy beam to detect the incident position of the incident energy beam.

7. The apparatus for energy beam position alignment according to claim 3, wherein the beam detecting unit includes an image detecting unit configured to capture an image of the incident energy beam to detect the incident position of the incident energy beam.

8. The apparatus for energy beam position alignment according to claim 1 further including a multi-layer body and a light detecting unit, the multi-layer body having a diffuser plate and a wavelength conversion element, the multi-layer body being disposed on a light incident side of the image detecting unit, the multi-layer body having an opening at a center of the multi-layer body, the opening being configured to allow the incident energy beam to pass therethrough, the diffuser plate being disposed closer to the image detecting unit than the wavelength conversion element, the opening having a diameter that allows both of the first and second energy beams to pass therethrough when the first and second energy beams have predetermined positional relationship, and the light detecting unit being disposed in the vicinity of the multi-layer body and configured to detect presence and absence of a diffused light, which is emitted from the multi-layer body, and determine whether the incident position of the first energy beam and the incident position of the second energy beam no longer have desired positional relationship.

9. The apparatus for energy beam position alignment according to claim 2 further including a multi-layer body and a light detecting unit, the multi-layer body having a diffuser plate and a wavelength conversion element, the multi-layer body being disposed on a light incident side of the image detecting unit, the multi-layer body having an opening at a center of the multi-layer body, the opening being configured to allow the incident energy beam to pass therethrough, the diffuser plate being disposed closer to the image detecting unit than the wavelength conversion element, the opening having a diameter that allows both of the first and second energy beams to pass therethrough when the first and second energy beams have predetermined positional relationship, and the light detecting unit being disposed in the vicinity of the multi-layer body and configured to detect presence and absence of a diffused light, which is emitted from the multi-layer body, and determine whether the incident position of the first energy beam and the incident position of the second energy beam no longer have desired positional relationship.

10. The apparatus for energy beam position alignment according to claim 3 further including a multi-layer body and a light detecting unit, the multi-layer body having a diffuser plate and a wavelength conversion element, the multi-layer body being disposed on a light incident side of the image detecting unit, the multi-layer body having an opening at a center of the multi-layer body, the opening being configured to allow the incident energy beam to pass therethrough, the diffuser plate being disposed closer to the image detecting unit than the wavelength conversion element, the opening having a diameter that allows both of the first and second energy beams to pass therethrough when the first and second energy beams have predetermined positional relationship, and the light detecting unit being disposed in the vicinity of the multi-layer body and configured to detect presence and absence of a diffused light, which is emitted from the multi-layer body, and determine whether the incident position of the first energy beam and the incident position of the second energy beam no longer have desired positional relationship.

11. The apparatus for energy beam position alignment according to claim 4 further including a multi-layer body and a light detecting unit, the multi-layer body having a diffuser plate and a wavelength conversion element, the multi-layer body being disposed on a light incident side of the image detecting unit, the multi-layer body having an opening at a center of the multi-layer body, the opening being configured to allow the incident energy beam to pass therethrough, the diffuser plate being disposed closer to the image detecting unit than the wavelength conversion element, the opening having a diameter that allows both of the first and second energy beams to pass therethrough when the first and second energy beams have predetermined positional relationship, and the light detecting unit being disposed in the vicinity of the multi-layer body and configured to detect presence and absence of a diffused light, which is emitted from the multi-layer body, and determine whether the incident position of the first energy beam and the incident position of the second energy beam no longer have desired positional relationship.

12. The apparatus for energy beam position alignment according to claim 1, wherein the light source device is a discharge produced plasma type extreme ultraviolet light source device or a laser produced plasma type extreme ultraviolet light source device.

13. The apparatus for energy beam position alignment according to claim 1 further including an alignment chamber configured to house the optical unit, the movable mirror, the beam detecting unit, and the branching unit, said alignment chamber being purged by a dry gas.

14. A method for energy beam position alignment, for use with a light source device having a first energy beam radiation unit for emitting a first energy beam and a second energy beam radiation unit for emitting a second energy beam, said light source device being adapted to irradiate a material of extreme ultraviolet radiation with the first energy beam and to direct the second energy beam to or in the vicinity of a first position on the material, which is irradiated with the first energy beam, thereby exciting the material, producing plasma and extracting extreme ultraviolet light from the plasma, said method comprising:

preparing an optical unit configured to allow the first energy beam to pass therethrough, and to reflect the second energy beam;

causing the first energy beam to be incident to the optical unit;

causing the first energy beam, which passes through the optical unit, to be incident to a movable branching unit and to be reflected by the movable branching unit;

guiding the reflected first energy beam toward a beam irradiation position on the material;

causing the branching unit to branch part of the first energy beam;

detecting said part of the first energy beam by a beam detecting unit;

reflecting the second energy beam by a movable mirror and causing the reflected second energy beam to be incident to the optical unit;

causing the second energy beam, which is reflected by the optical unit, to proceed in a substantially same direction as the first energy beam;

causing the second energy beam to be incident to the branching unit and to be reflected by the branching unit;

guiding the second energy beam toward the beam irradiation position on the material;

reflecting the second energy beam by the optical unit;

branching part of the reflected second energy beam by the branching unit;

detecting the branched part of the second energy beam by the beam detecting unit; and actuating the movable mirror and the branching unit, based on a detection result obtained from the beam detecting unit, such that a second position on the material, which is irradiated with the second energy beam, has predetermined positional relationship with the first position of the first energy beam.

15. The method for energy beam position alignment according to claim 14 further including:

disposing a movable lens between the optical unit and the branching unit such that the movable lens is able to move in an optical axis direction;

detecting a first beam spot diameter of the first energy beam by the beam detecting unit;

detecting a second beam spot diameter of the second energy beam by the beam detecting unit; and actuating the movable lens to cause the first beam spot diameter and the second beam spot diameter to become a predetermined value.

16. The method for energy beam position alignment according to claim 14, wherein the light source device is a discharge produced plasma type extreme ultraviolet light source device or a laser produced plasma type extreme ultraviolet light source device.

17. The method for energy beam position alignment according to claim 14 further including preparing an alignment chamber configured to house the optical unit, the movable mirror, the beam detecting unit, and the branching unit, and purging the alignment chamber by a dry gas.

* * * * *